United States Patent [19]

Fey

[11] Patent Number: 5,070,564

[45] Date of Patent: Dec. 10, 1991

[54] GATE BOX LID LIFTER

[76] Inventor: Victor W. Fey, 129 3rd Ave. N.E., Cut Bank, Mont. 59427

[21] Appl. No.: 691,370

[22] Filed: Apr. 25, 1991

[51] Int. Cl.[5] ..... B25F 1/00; B66F 11/00

[52] U.S. Cl. ..... 7/170; 7/166; 294/16; 294/104; 254/131; 29/254

[58] Field of Search ..... 7/166, 170, 114; 294/2, 294/3, 16, 17, 15, 24, 26, 50.9, 104; 254/131; 29/254; 81/463

[56] References Cited

U.S. PATENT DOCUMENTS

| | | | |
|---|---|---|---|
| 103,330 | 5/1870 | Heusser | 254/19 |
| 344,653 | 6/1886 | Harmon | 7/166 |
| 357,644 | 2/1887 | Tucker | 7/166 |
| 1,995,509 | 3/1935 | Hayden | 294/104 |
| 2,475,041 | 7/1949 | Mattson | 30/164.6 |
| 4,482,182 | 11/1984 | Mortensen | 254/131 |
| 4,650,232 | 3/1987 | Perry | 254/131 |
| 5,004,282 | 4/1991 | Perry | 254/131 |

*Primary Examiner*—Roscoe V. Parker

[57] ABSTRACT

A tool suitable for breaking loose foreign material wedged between a gate box lid and a gate box and also the foreign material wedged into the recesses on the gate box lid. The tool also may be used to grab hold and lift the gate box lid for removal and replacement of the same. To achieve these functions the tool embodies a slide hammer, a drive nut and chisel and a set of jaws.

1 Claim, 3 Drawing Sheets

GATE BOX LID LIFTER

BACKGROUND OF THE INVENTION

1. Field of the Invention

The present invention relates to a tool suitable for breaking loose the foreign material wedged between the gate box lid and the gate box and foreign material wedged into the recesses on the gate box lid, grabbing hold and lifting of the gate box lid, and the removal and replacement of the gate box lid.

2. Description of Prior Art

It is well known that city water shut-off valves are positioned below ground level. Access to these shut-off valves is achieved by use of a key inserted through an entrance hole at ground level and down a vertical extending access conduit. This access conduit is usually a cylindrical pipe having an approximate 8" diameter. Such access conduits are commonly called "gate boxes".

The access conduit entrance is invariably provided with a cover (the gate box lid). For safety, security and durability, this lid is usually fabricated from a rigid material such as cast iron. The lid has a depth of approximately 3 7/16".

Primarily to prevent rainwater and dirt from entering the access conduit, the gate box lids do not have any holes that go all the way through them. Instead, they are formed with recesses in their top surface at 180° intervals on the top, outer circumferential edge of the lid.

One technique that has been tried for lifting and removing the gate box lids is a pair of tongs which are inserted into the two recesses. This relies on a tight grip by the operator as the jaws on the tongs are not fitted for the recesses. The tongs provide no means of breaking the seal around the lid or for extracting foreign material from the gate box lid recesses.

Another technique that has been tried for lifting or maneuvering these lids include the use of crow bars (or similar rod-like tools) which are inserted into one of the recesses on the lid. This relies on friction between the lid and the tool to affect the lifting of the lid. There is very little control over the movement of the lid, and there is a significant risk of injury to the operator.

Art has been designed suitable for the lifting or removal of manhole covers, which are larger, heavier and having less proportional depth. See e.g. U.S. Pat. Nos. 4,650,232 and 4,482,182. Art has been designed for percussion type tools suitable for box openers and chisels. See e.g. U.S. Pat. Nos. 103,330 and 2,475,041.

SUMMARY OF THE INVENTION

This invention relates to a combination implement which embodies a slide hammer, drive nut and chisel, and a set of jaws. It being the object of the invention to provide a single tool or implement by which all of the operations usually necessary in removing a gate box lid can be performed.

To achieve this purpose, the present invention comprises a slide hammer on a rigid shaft positioned above the chisel end of the tool. A drive nut is mounted on the shaft below the slide hammer, whereby heavy blows upon the drive nut, by the slide hammer, will be absorbed and transmitted to the chisel, to extract foreign material from the gate box lid notches and to jar the gate box lid loose from the gate box. The shaft has a stationary jaw which is adapted to be inserted in one of the notches. The shaft also has a pivot attachment point adjacent to the stationary jaw. There is provided a second movable jaw, which is mounted on the pivot atachment point, the second jaw being adapted to be inserted into one of the notches upon a pivoting of the jaw relative to the shaft. The jaws will then act to grip the lid between them. The spring tension will pull the jaws together providing a secure grip on the lid, the spring tension and the weight of the lid will prevent the jaws from releasing the lid until the stationary jaw is released through a forward motion of the shaft.

With the above and other objects in view, which will appear as the description proceeds, the invention resides in the novel construction, combination and arrangement of parts, substantially as hereinafter described, and more particularly defined by the appended claim. It being understood that such changes in the precise embodiment of the herein disclosed invention may be made as come within the scope of the claim.

DETAILED DESCRIPTION OF PREFERRED EMBODIMENTS OF THE INVENTION

Figure 1:
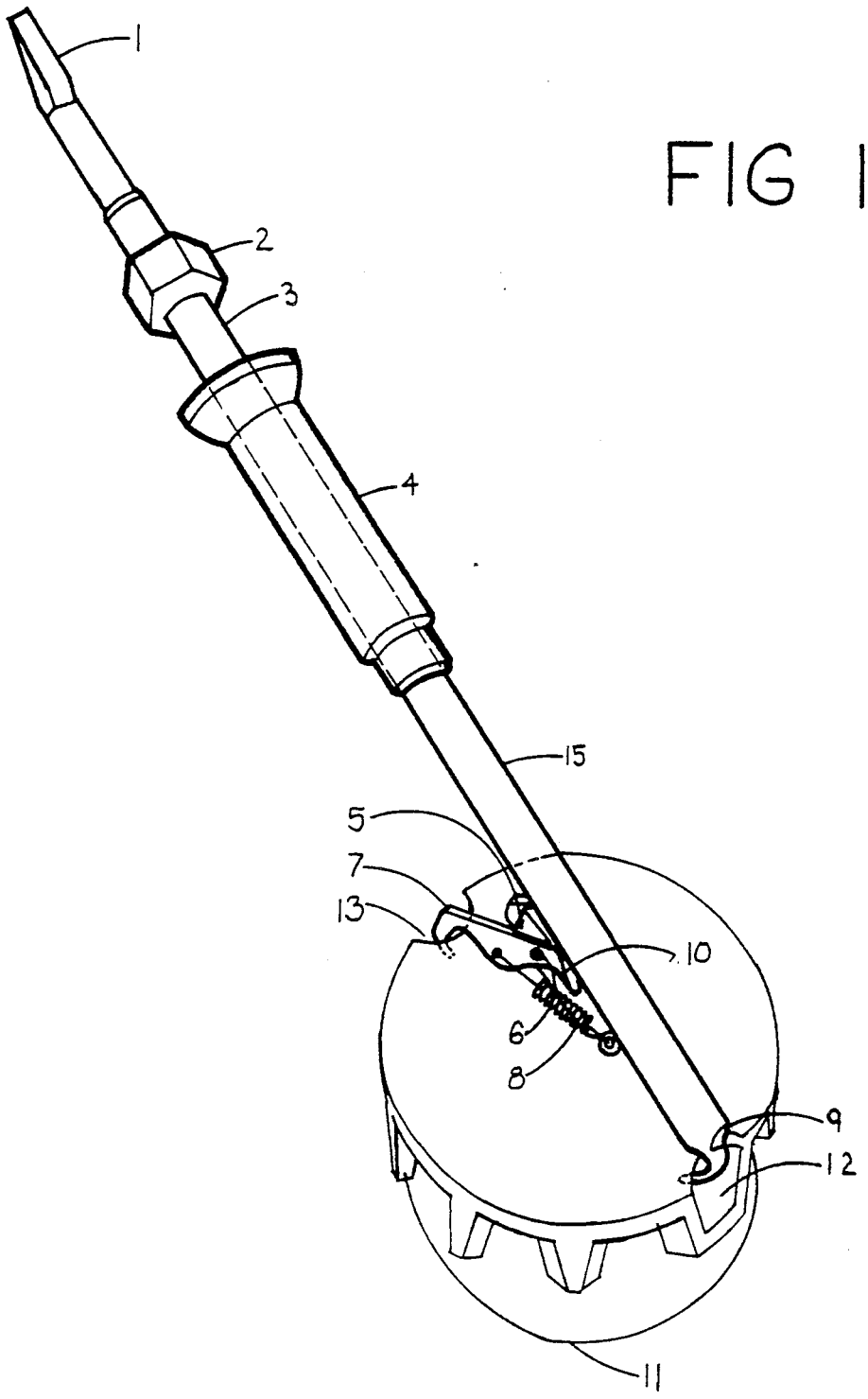
FIG. 1 is a perspective view of a Gate Box Lid Lifter, embodying the present invention which is being used to lift gate box lid.
Figure 2:
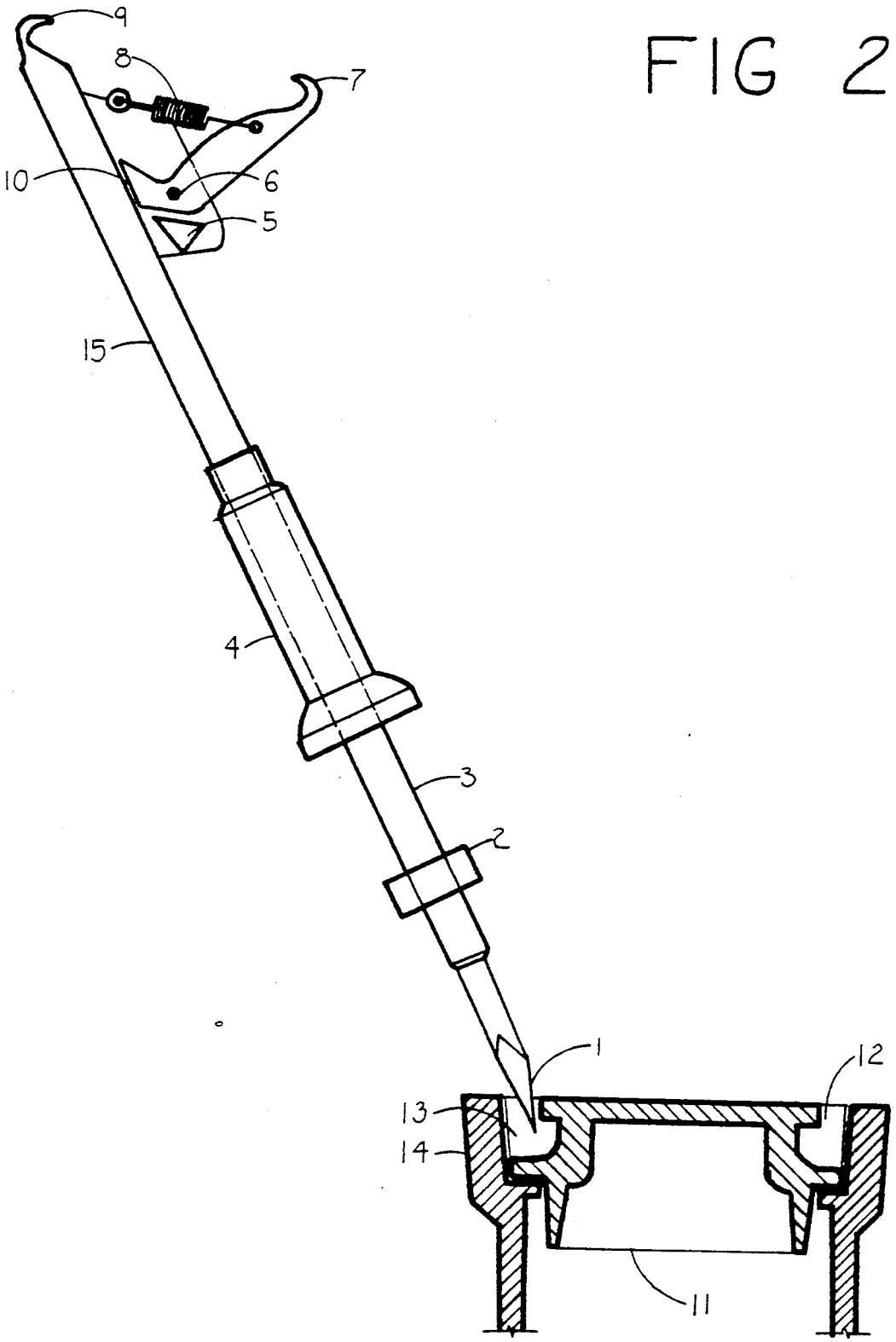
FIG. 2 is a side elevational veiw of the chisel end of the Gate Box Lid Lifter, being used to clear notches and break the lid loose from the gate box.
Figure 3:
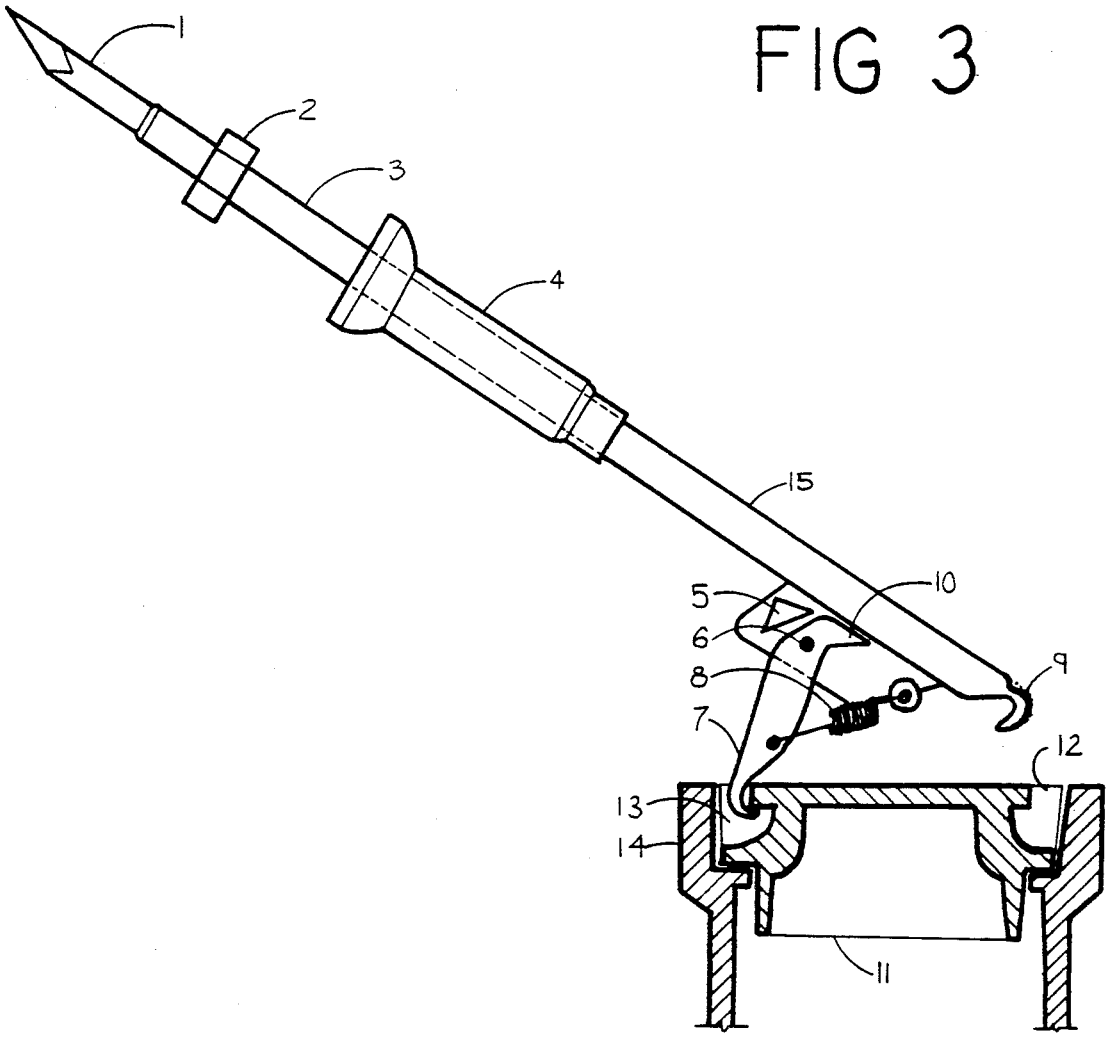
FIG. 3 is a side elevational view of the jaws of the Gate Box Lid Lifter being engaged into or disengaged from notches in the gate box lid.

Referring now to FIGS. 1–3 of the drawings, it can be seen that there is a Gate Box Lid Lifter, referred to generally by the number 15, which is suitable for breaking loose and lifting a gate box lid (11). The lid 11 has two recessed notches 12 and 13 in the top surface at 180° intervals around outer circumferential edge.

The tool 15 has a substantially rigid support shaft 3 with a chisel 1 forged on one end and a drive nut 2 adjacent to the chisel's inner end.

In FIG. 2 a slide hammer 4 slides on the shaft 3 delivering blows to the drive nut 2 which in turn drives the chisel 1 down into the notch 13 in the gate box lid 11. After chisel 1 is embedded in notch 13, a downward push of the shaft 3 on stationary jaw 9 end will pry lid 11 loose from gate box 14 and clean the notches. This procedure is done to both notches 12 and 13.

In FIG. 3 there are two descriptions of the drawing, the first being an insertion of the tool 15 into the notches 12 and 13 in lid 11. With one hand grasping chisel end and the other hand grasping the shaft 3 just above stopper 5, the movable jaw 7 is inserted into notch 13. The pivot pin 6 allows movable jaw 7 to pivot as tool 15 is being pushed toward notch 12 against the tension of spring 8. To prevent extreme over expansion of jaws 7 and 9, a stopper 5 is provided adjacent to pivoting end of movable jaw 7. When stationary jaw 9 is positioned over notch 13 an upward motion of chisel 1 end will rotate tool 15 allowing stationary jaw 9 to be inserted into notch 13. Releasing the hand applied sideward pressure on tool 15 will allow spring 8 to contract the two jaws 7 and 9 resulting in a positive grip of tool 15 in notches 12 and 13 as can be seen in FIG. 1. The two jaws 7 and 9 are arranged in such a position whereas when tool 15 is lifting lid 11, the grip of the two jaws 7 and 9 is amplified by the weight of the lid 11.

The second description of the drawing FIG. 3 is the release of the tool 15 from lid 11. As in the description of tool 15 being inserted into lid 11, one hand is grasping chisel 1 end and the other is grasping shaft 3 just above stopper 5. With the weight of lid 11 absent, tool 15 can be released by pushing tool 15 toward its, stationary jaw 9 end and applying a downward movement of chisel end thus rotating stationary jaw 9 out of notch 12. Releasing the hand applied tension of the sideward push of tool 15, will allow spring 8 to pivot movable jaw 7 to stopper 10 allowing tool 15 to be lifted free from lid 11.

In the previous description of FIG. 3 of tool 15 being inserted into notches 12 and 13 of lid 11 and of tool 15 being released from notches 12 and 13, let it be known that tool 15 will grasp or release lid 11 when lid 11 is out of gate box 14 such as lid 11 sitting on street, ground, mud or ice.

What is claimed is:

1. A combination tool designed for the breaking loose of the seal around the gate box, for the removal of obstructions in the gate box lid's recesses, and the removal and replacement of the gate box lid, comprising of the following:

a rigid shaft having first and second ends;

a chisel at said first end of said rigid shaft, which together with a slide hammer positioned above said chisel, together are used for the dislodging of gate box lids from gate boxes and adapted to free gate box lid recesses from foreign material, by applying blows with said slide hammer upon a drive nut adjacent to said chisel, wherein said force is transmitted to the chisel, a stationary jaw at said second end of said rigid shaft, together with a movable jaw on a pivot pin positioned adjacent to said stationary jaw, with a spring positioned between the two jaws, which said spring will allow jaws to contract, whereas said jaws are adapted for insertion into notches of gate box lid for removal and replacement, a stopper positioned behind said movable jaw prevents over-expansion of jaws and a stopper positioned on the movable jaw prevents collapse of jaws.

* * * * *